US008590898B2

(12) United States Patent
Buza

(10) Patent No.: US 8,590,898 B2
(45) Date of Patent: Nov. 26, 2013

(54) CASINO TABLE GAME

(76) Inventor: Donald E. Buza, Ortonville, MI (US)

( * ) Notice: Subject to any disclaimer, the term of this patent is extended or adjusted under 35 U.S.C. 154(b) by 0 days.

(21) Appl. No.: 13/491,566

(22) Filed: Jun. 7, 2012

(65) Prior Publication Data

US 2012/0242041 A1 Sep. 27, 2012

Related U.S. Application Data

(63) Continuation of application No. 13/374,636, filed on Jan. 4, 2012, now abandoned, which is a continuation-in-part of application No. 13/065,204, filed on Mar. 16, 2011, now abandoned.

(51) Int. Cl.
*A63F 3/00* (2006.01)

(52) U.S. Cl.
USPC ..... 273/284; 273/274; 273/309

(58) Field of Classification Search
USPC ..... 273/274, 292, 142 E, 284, 287, 309
See application file for complete search history.

(56) References Cited

U.S. PATENT DOCUMENTS

| | | | | | |
|---|---|---|---|---|---|
| 25,529 | A * | 9/1859 | Sargent | 273/284 |
| 557,646 | A * | 4/1896 | Booth | 273/243 |
| 646,549 | A * | 4/1900 | Aberli | 434/153 |
| 1,246,860 | A * | 11/1917 | Brachtl et al. | 40/518 |
| 2,800,330 | A * | 7/1957 | Pickard | 273/254 |
| 3,152,806 | A * | 10/1964 | Jackman | 273/272 |
| 3,386,739 | A * | 6/1968 | Lino | 273/269 |
| 3,804,418 | A * | 4/1974 | Sander | 273/284 |
| 3,926,439 | A * | 12/1975 | Chao et al. | 273/237 |
| 4,149,728 | A * | 4/1979 | Thompson | 273/274 |
| 4,222,572 | A * | 9/1980 | Baker | 273/306 |
| D271,983 | S * | 12/1983 | Bachmann et al. | D20/5 |
| D296,222 | S * | 6/1988 | Tomaso, Jr. | D21/369 |
| 5,588,654 | A * | 12/1996 | Voigt et al. | 273/284 |
| 5,887,873 | A * | 3/1999 | Freeman | 273/303 |
| 5,918,884 | A * | 7/1999 | DiMuro | 273/292 |
| 5,944,316 | A * | 8/1999 | Hernandez | 273/292 |
| 6,065,752 | A * | 5/2000 | Beltran | 273/274 |
| 6,264,200 | B1 * | 7/2001 | Smith | 273/274 |
| 6,431,548 | B1 * | 8/2002 | Voigt et al. | 273/284 |
| 6,769,693 | B2 * | 8/2004 | Huard et al. | 273/274 |
| 7,175,178 | B2 * | 2/2007 | El Kai | 273/274 |
| 7,195,242 | B2 * | 3/2007 | Terminel et al. | 273/274 |
| 2001/0015529 | A1 * | 8/2001 | Allen | 273/292 |
| 2002/0190467 | A1 * | 12/2002 | Braun | 273/274 |
| 2005/0236772 | A1 * | 10/2005 | Chen | 273/284 |

* cited by examiner

*Primary Examiner* — William Pierce
(74) *Attorney, Agent, or Firm* — Inventa Capital PLC

(57) ABSTRACT

A system and method of the inventive concept presents a casino game that is a table based card game that is generally played with a dealer, who deals the cards, and with players whom make the wagers. The game consists of multiple rounds and a player can wager and win on individual rounds or multiple rounds to make a "poker" hand. Additionally, there may be a progressive jackpot offered on the "poker" hands for players to wager upon.

4 Claims, 4 Drawing Sheets

CASINO TABLE GAME

RELATED APPLICATIONS

This application is a continuation application of a continuation in part application Ser. No. 13/374,636 filed on Jan. 4, 2012 that claims priority to a continuation in part application Ser. No. 13/065,204 filed on Mar. 16, 2011 and incorporated herewith by reference in its entirety.

FIELD OF INVENTION

This invention pertains generally to the field of card and table based casino game and in particular to a multi-round table game and method of playing the same.

BACKGROUND OF THE INVENTION

Casinos become more popular as years go by. Casinos try to compete with one another to attract attention of patrons. The casinos who have most exciting games will prevail because these games of chance will keep the patrons entertained and increase the choices and diversity of the games of chance located on the casino floors. There are several casino style games of chance that have been played for many years, such as Roulette, Black Jack, and Poker in limited forms. There have also been some recent inventive activities to find that one game which can find its place in the hearts of gamblers. The latter include game such as Black Jack, Roulette, Craps and Baccarat. Many of these games have evolved elaborate conventions, which whilst well understood by experienced players, are intimidating to new table game players. Further, these games have rules, which may be simple once understood, but take some time to learn. For many players there is a fear that they will make a mistake and either appear foolish to the other players and staff, or lose their money unnecessarily. As a result, many players only play electronic gaming machines, as they can make a mistake without embarrassment.

The art is replete with various prior art references teaching different table games and methods. U.S. Pat. No. 4,006,906 to Gruber discloses a specific game using a 121-card deck that seems to separate color and suit. However, nothing in the patent specifies that suit, color, and rank must be genuinely independent, and their exact relationship remains obscure. The deck is much too large for general use, and most standard games have no need of the patented game's implied restrictions on suit symbols.

U.S. Pat. No. 5,887,873 to Freeman teaches a game that includes a deck of cards, tiles, or similar playing pieces, real or simulated on a computer or other device, chiefly characterized by a trilateral organization comprising three independent aspects: suit, value, and color or color group. The plurality of cards representing each element of each aspect comprise approximately equal pluralities of each element of each of the other aspects. Except for auxiliary cards, each card in a single deck represents a unique combination of a single suit, a single color group, and a single value or rank. The preferred form of the invention is a series of related triadic decks of playing cards comprising three suits and three color groups, nonsexist or gender-neutral picture cards, an improved layout, and indicative card backs. The layout improvement typically involves additional set designation markers in the two commonly vacant corners of a card face. Backs are uniform for all cards in a deck but different from deck to deck; the use of the elements of the back is sufficient to remind a player of the general configuration of the deck being used.

U.S. Patent Publication No. 20010015529 to Allen teaches a method for playing the casino game utilizing playing cards. The player makes at least one of the following wagers, a card value and suit, excluding Kings a suit, a suit color, and/or groups of card values and suits. From a standard deck of playing cards or preferably a standard deck of fifty-two cards with an additional Joker, a non-King playing card is randomly selected as the table card. If the table card does not correspond to any card value and/or suit or suit color wagered upon by the player, the players wager is lost and if the table card corresponds to a card value and/or suit or suit color wagered upon by the player, the player is paid an amount based upon his wager.

U.S. Patent Publication No. 20040066001 to Duncombe et al. teaches a method of operating a casino card game. The game is played with one or more decks of cards. The game includes a playing surface includes first marked areas for placing wagers on one or more aspects of the face value of a single card. A second marked area for placing wagers on one or more aspects of the face values of a plurality of successively dealt single cards. The method permits the players to place wagers in the first and second marked areas. Then the dealer deals a single card. The dealer collects and pays the wagers placed in the first marked area according to the face value of the single card. The game permits the players to place new wagers in the first marked areas.

There is a longstanding need and opportunity for new games that will be easy to learn, fun to play, and more over will be exciting and attract attention of new patrons thereby generating revenue for the casinos. This inventive casino game and method will provide this game and will eliminate drawbacks associated with aforementioned prior art casino games and methods.

SUMMARY OF THE INVENTION

A game of the present invention is a table based card game that is generally played with a dealer, who deals cards and with players who make wagers. The game includes multiple rounds and each player can bet and win on individual rounds or multiple rounds to make a "poker" hand.

The game is played on any size table with at least one deck of playing cards or more, preferably using decks comprised of a standard fifty-two-card deck, more preferably with at least both jokers left in, although it could include even more than two jokers, bringing the total of each deck to about fifty-four cards. The table may present various configurations and includes several sections. A first area or playing field presents a plurality of rows. Preferable there are four rows. Each row is divided to a multitude of cells. Each cell includes an image of a card having the same suit. The cards range from Ace to 2 with Ace being the first card located in upper section and 2 being the last card located in a bottom section. The remaining three rows have three suits such as Clubs, Diamonds, and Hearts and also have sections ranging from Ace to 2. All cells of all four rows that contain Aces define an upper line of the first area. All sections of all "2" define a lower line of the first area. The upper and lower lines and spaced by side lines.

One of the side lines faces a dealer station and the other side line faces player locations. A color section extends from the lower line. The color section is divided into two sectors, such as "Red" and "Black". A Joker section extends from the upper line. The Joker section is divided into "Blue Joker" and Yellow Joker" sections. The side line further extends to a third section extending from the upper line to the lower line thereby adding another cell to each cells of the four rows having different suits. Each cell of the third section have value of any of kind of cards located in these four rows. For example, if the cell of the third section is adjacent the rows of these four rows having "Aces" of different suits such as Spade, Clubs, Diamonds, and Hearts, then the cell of the third section will say "Any of Ace".

A fourth section extends from the third section. The fourth section is divided into two parts. One part is called" Any face or Ace" and the other part is called" Any number 2 through 10". A payout section is located between the playfield and a dealer station. The payout section includes a plurality of subsections defining a poker wager area that allow the players to place their bets. These subsections include "Flush", "Royal Flush", "Straight Flush", "Straight", "5 of A Kind", " 4 of A Kind", "3 of A Kind", "Full House", " Two Pairs", and "One Pair" each presenting different winning combination values. The payout section also includes a card section having five card segments that allows the dealer to deal five cards before the results of each game round are announced. The dealer determines the winning outcome of each round as the dealer opens a card placed in order to each of the five card segments of the card section in order to determine a winner of a jackpot after all cards placed on each of the segments define one of the winning options such as "Flush", "Royal Flush", "Straight Flush", "Straight", "5 of A Kind", " 4 of A Kind", "3 of A Kind", "Full House", " Two Pairs", and "One Pair" presenting different winning combination.

The game starts with no cards on the table and continues until the final card is dealt (e.g. third, fifth, or seventh card). Within the game, there are multiple "rounds", which can vary from as little as three to as many as seven or more in number, as discussed in the embodiments below. To start the game, the players place wagers (e.g. casino chips, cash, tangible property) anywhere on the entire playing field and all of the aforementioned sections. The players may bet, or single round wager, the individual card to come out next, they may bet it on a split (2-way), or on a corner (4-way), may bet any suit, or color, they may bet any number, or the Jokers. Additional, wagering includes the "poker hand bets", which can only be made prior to the first card being dealt in the full-game. "Poker" wagers, or multi-round wagers, are preferably placed in the poker wager area in a separate area of the field. Optionally, the dealer may place the wagers in the poker wager area for the players, thus restricting access to that area of the table. The poker hand wagers, eight in total, which includes "Flush", "Royal Flush", "Straight Flush", "Straight", "5 of A Kind", " 4 of A Kind", "3 of A Kind", "Full House", " Two Pairs", and "One Pair". The players, from as few as one to as many as ten or more, approach the table and buy in, with either a cash or a casino checks, and receive colored, preferably table specific chips, one unique color per player. The value of each of these chips is variable based off the player's buy in and once value is determined, dealer places a value marker on top of one chip of that color in the dealer area. In a first preferred exemplary embodiment, the players make an initial wager, either inside the field, the outside of the playing field, or in the poker wager area or any combination of these bets. Once these initial wagers have all been placed, the dealer takes the top card off the deck and places it face down as a "Burn Card." A "Burn Card" serves numerous important purposes.

First, this is used to completely mask the outcome card from view, disabling any marked card or potential thereof. Secondly, the burn card has the effect of tantalizing the player as to what might have been the next card (e.g. every other card in the deck instead of five cards in a row). Then the next card is flipped face up and this is the "Outcome Card". The outcome card is placed in the outcome card place on the table. The dealer then marks on the field the position that matches the outcome card and clears all the bets that have not won, (except the "poker hand" wagers which cannot be determined until outcome card number five is shown), then dealer pays the wins.

It is contemplated by this invention that marking the corresponding position on the field can be accomplished my many methods or marking means. In one preferred marking embodiment, marking is accomplished by the dealer placing a physical marker (e.g. a blank chip, a figurine, or the like) on the field position corresponding to the outcome card. In another preferred marking embodiment, the dealer activates a switching device that illuminates the field position or a portion thereof, corresponding to the outcome. This completes a round.

The players may bet the field again towards what the next outcome card will be, and the process is repeated until the fifth round and last outcome card is shown, to which wagers are cleared and paid as before and if a "poker hand" has been made from the five outcome card then the correlating "poker hand bet" marked and is paid and the rest are cleared, completing the "full-game". Once the entire field is cleared, a new "full-game" can begin again. In a second preferred exemplary embodiment, Players make a one-time wager, either inside the field, the outside of the field, or in the poker wager area or any combination of these bets.

Once these one-time wagers have all been placed, the dealer takes the top card off the deck and places it face down as a "Burn Card." Then the next card is flipped face up and this is the "Outcome Card". The outcome card is placed in the outcome card place on the table. The dealer then marks on the field the position that matches the outcome card. The dealer then repeats the burn card, outcome card and marking steps (after the final time, dealer also marks any winning poker hand positions) until all outcome cards are showing. Only at this point, the dealer clears all the bets that have not won, and then pays the wins. This then completes the game.

For a player to win the poker hand "Progressive Jackpot" bet, players must wait through all single card betting rounds which results in all the cards coming out (for that game) and making a poker hand. Note that a Joker shown as part of the shown outcome cards, counts as a wild card, or has multiple values, and only the best possible poker hand wins. After a short time, the dealer will close or stop allowing players to make bets, by stating "no more bets" or an equivalent phrase, at which time no further "poker hand bets" or "Progressive Jackpot bets" will be allowed until the next game begins.

An advantage of the present invention is to provide providing a new game of chance that incorporates the excitement of a traditional card game, while giving the patron a potential high payout from their wager and increasing the choices and diversity of games of chance.

Another advantage of the present invention is to provide a new game that will attract those who may be intimidated by existing table games.

Still another advantage of the present invention is to provide a new game that is easy to be explained to those who never played the games of chance.

Still another advantage of the present invention is to provide a new game wherein no elaborate strategies or systems need to be learned by the players to play and enjoy the game.

Still another advantage of the present invention is to provide a new game having a mechanical device adaptable to change the surface of the table wherein the user may choose between a game of the present invention wherein segments such as "Flush", "Royal Flush", "Straight Flush", "Straight", "5 of A Kind", " 4 of A Kind", "3 of A Kind", "Full House", " Two Pairs", and "One Pair" will appear on the surface of the table as illustrated in FIG. 1 and a conventional poker game when the mechanical device will allow the user to eliminate the segments such as "Flush", "Royal Flush", "Straight Flush", "Straight", "5 of A Kind", " 4 of A Kind", "3 of A Kind", "Full House", " Two Pairs", and "One Pair" as illustrated in FIG. 2.

Other advantages and meritorious features of this invention will be more fully understood from the following description of the preferred embodiment, the appended claims, and the drawings; a brief description of which follows.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
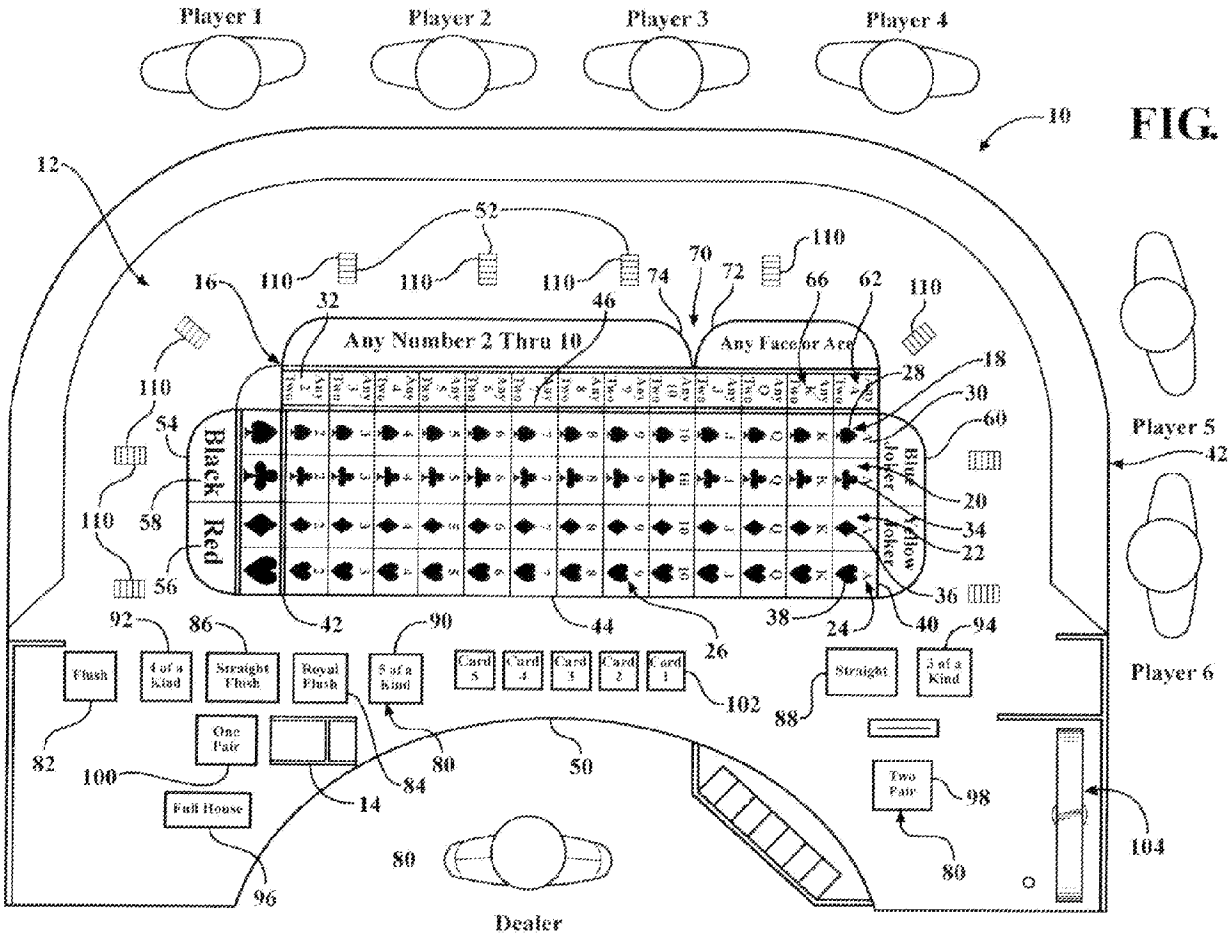
FIG. 1 illustrates a top view of a table of a casino game of the present invention.

Referring to FIG. 1, wherein like numerals indicate like or corresponding parts, a game of the present invention is generally shown at 10. The game 10 is played on a table, generally indicated at 12. The table 12 may present various sizes and configurations without limited the scope of the present invention.

The configuration of the table 12 as shown in FIG. 1 is one of the configurations not intended to limit the scope of the present invention. There is at least one deck of playing cards (not shown) or more is used in the game. The deck of cards is placed in a card holder 14. Preferably the decks include a standard fifty-two-card deck, more preferably with at least both jokers left in, although it could include even more than two jokers, bringing the total of each deck to about fifty-four cards.

A first area or playing field is generally indicated at 16. The first area 16 presents a plurality of rows generally indicated at 18, 20, 22, and 24. Preferable there are four rows. The number of rows is not intended to limit the scope of the present invention. Each row 18 through 24 is divided to a multitude of cells (only one of the cells is shown as generally indicated at 26). Each cell 26 includes an image of a card having the same suit, such as Spade, as shown at 28. The cards range from Ace, as shown at 30, to 2, as shown at 32, with Ace being the first card located in an upper section and 2 being the last card located in a bottom section. The remaining three rows have three suits such as Clubs, shown at 34, Diamonds, shown at 36, and Hearts, shown at 38. These three rows 20, 22, and 24 also have cells 26 ranging from Ace to 2, i.e. Ace, King, Quinn, Knight, 10, 9, 8, 7, 6, 5, 4, 3, and 2. All cells 26 of all four rows 18, 20, 22, and 24 that contain Aces define an upper line 40 of the first area 16. All sections that contain "2" define a lower line 42 of the first area 16. The upper and lower lines 40 and 42 and spaced by side lines 44 and 46.

One of the side lines 44 faces a dealer station 50 and the other side line 46 faces player locations 52. A color section 54 extends from the lower line 42. The color section 54 is divided into two sectors, such as "Red" 56 and "Black" 58. A Joker section 60 extends from the upper line 40. The Joker section 60 is divided into "Blue Joker" and Yellow Joker" sections. The side line 46 further extends to a third section, generally indicated at 62 extending from the upper line 40 to the lower line 42 thereby adding another cell (only one is generally indicated at 66) to each cell 26 of the four rows 18, 20, 22, and 24 having different suits. Each cell 66 of the third section 62 has value of any of kind of cards located in these four rows 18, 20, 22, and 24. For example, if the cell 66 of the third section 62 is adjacent the rows of these four rows having "Aces" of different suits such as Spade, Clubs, Diamonds, and Hearts, then the cell 66 of the third section 62 will say "Any of Ace".

Figure 2:
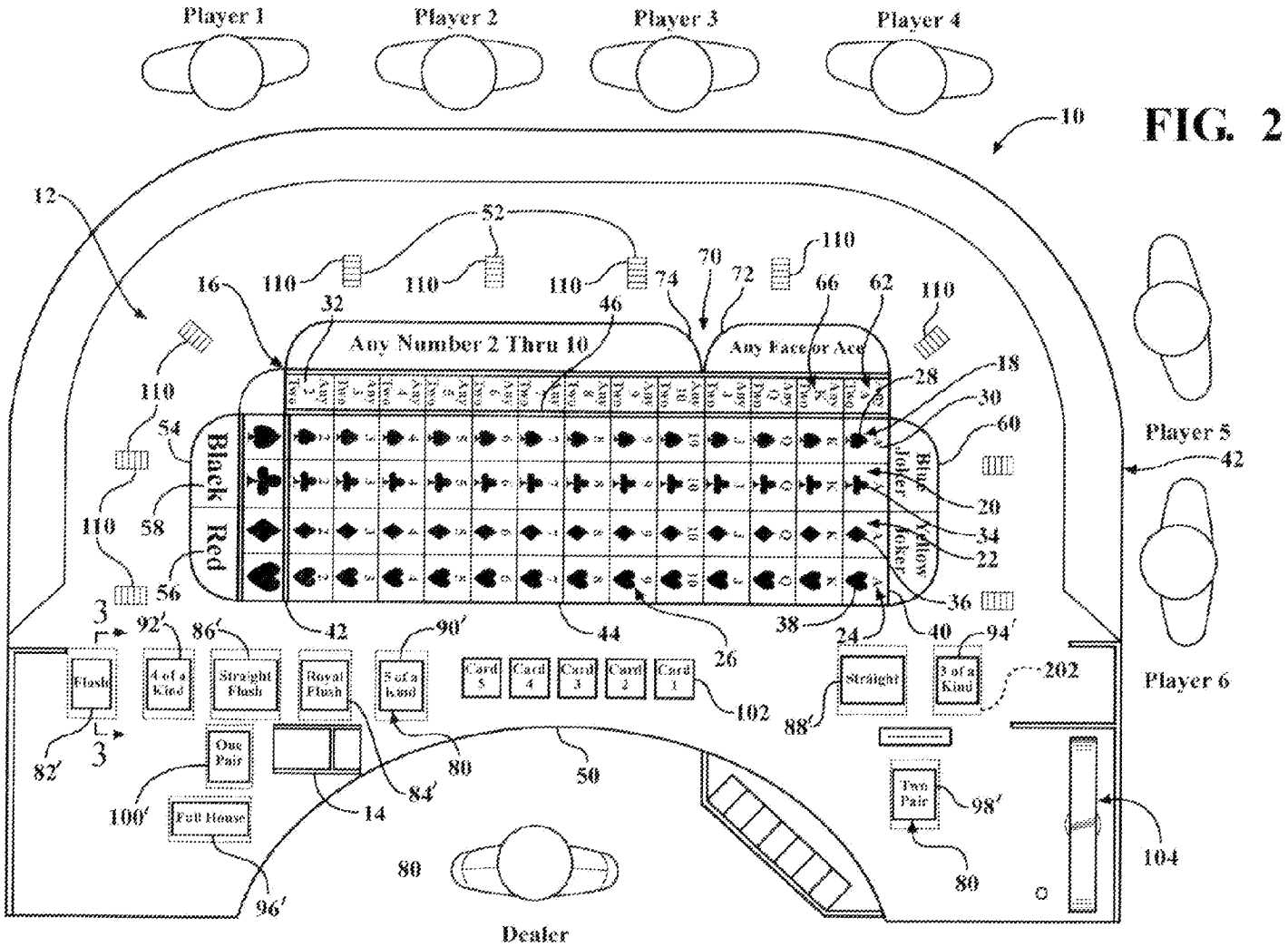
FIG. 2 illustrates a top view of an alternative embodiment of the table of the casino game of FIG. 1.

A fourth section, generally indicated at 70, extends from the third section 62. The fourth section 70 is divided into two parts 72 and 74. One part 72 is called" Any face or Ace" and the other part 74 is called "Any number 2 through 10". A payout section, generally indicated at 80, is located between the playfield 16 and the dealer station 50. The payout section 80 includes a plurality of subsections that allow the players to place their bets. These subsections include a "Flush" subsection 82, a "Royal Flush" subsection 84, a "Straight Flush" subsection 86, a "Straight" subsection 88, a "5 of A Kind" subsection 90, a "4 of A Kind" subsection 92, a "3 of A Kind" subsection 94, a "Full House" subsection 96, a " Two Pairs" subsection 98, and a "One Pair" subsection 100. The payout section 80 also includes a five card segment 102 that allows the dealer to deal five cards before the results of each game round are announced. FIGS. 1 and 2 also illustrate an example of a display tree, generally indicated at 104. The display tree 104 may be placed adjacent the table 12 or may extend from the table 12 as illustrated in FIG. 1. The display tree 104 may have various configurations and detentions without limiting the scope of the present invention. Various colors, lights, and mechanisms can be employed to indicate winning combinations, jackpots, and all other information related to the game 10 thereby by making the game 10 more exciting.

There are about fifty-four cards in the game 10. The representations of the playing card disposed on the table top 12 can be in script, graphical form, or any combination of both. The game is played with the dealer D, who deals the cards and represents the "house" and with players P1 through P6 (more players can be involved to play the game without limiting the scope of the present invention) whom make the wagers. A "game" starts with no cards on the table 12 and continues until the final card is dealt (e.g. third, fifth, or seventh card). Within the game 10, there are multiple "rounds", which can vary from as little as three to as many as seven or more in number, as discussed in the embodiments below.

To start a game, the players place the wagers (e.g. casino chips, cash, tangible property) anywhere on the entire playing field 16. The wagers can be placed on the aforementioned sections, the players may bet, or single round wager, the individual card to come out next, they may bet it on a split (2-way), or on a corner (4-way), they may bet any suit, or color, they may bet any number, or the Jokers. Additional, wagering includes the "poker hand bets" (which can only be made prior to the first card being dealt in the full-game). "Poker" wagers, or multi-round wagers, are preferably placed in the payout section or a poker wager area 80 and on any of the "Flush" subsection 82, the "Royal Flush" subsection 84, the "Straight Flush" subsection 86, the "Straight" subsection 88, the "5 of A Kind" subsection 90, the "4 of A Kind" subsection 92, the "3 of A Kind" subsection 94, the "Full House" subsection 96, the "Two Pairs" subsection 98, and the "One Pair" subsection 100.

Optionally, the dealer may place the wagers in the payout section 80 for the players, thus restricting access to that area of the table. The poker hand wagers, includes at least "One Pair", "Two Pairs", "Three of a Kind", "Straight", "Flush", "Four of a Kind", "Straight Flush", "Royal Flush", and "Five of a Kind". The players, from as few as one to as many as ten or more, approach the table 12 and buy in, with either cash or casino checks, and receive colored, preferably table specific chips, one unique color per player. The value of each of these chips is variable based off the player's buy in and once value is determined, dealer places a value marker on top of one chip of that color in the dealer area.

The players make an initial wager, anywhere in the aforementioned areas on the table 12 or any combination of these bets. Once these initial wagers have all been placed, the dealer takes the top card off the deck and places it face down as a "Burn Card." A "Burn Card" serves numerous important purposes. First, this is used to completely mask the outcome card from view, disabling any marked card or potential thereof. Secondly, the burn card has the effect of tantalizing the player as to what might have been the next card (e.g. every other card in the deck instead of five cards in a row).

Then the next card is flipped face up and this is the "Outcome Card". The outcome card is placed in the outcome card place 102 on the table 12. The dealer then marks on the field the position that matches the outcome card and clears all the bets that have not won, (except the "poker hand" wagers which cannot be determined until outcome card number five is shown), then dealer pays the wins. It is contemplated by this invention that marking the corresponding position on the field can be accomplished my many methods or marking means. In one preferred marking embodiment, marking is accomplished by the dealer placing a physical marker (e.g. a blank chip, a figurine, or the like) on the field position corresponding to the outcome card. In another preferred marking embodiment, the dealer activates a switching device that illuminates the field position or a portion thereof, corresponding to the outcome. This completes a round.

The players may bet the field again towards what the next outcome card will be, and the process is repeated until the fifth round and last outcome card is shown, to which wagers are cleared and paid as before and if a "poker hand" has been made from the five outcome card then the correlating "poker hand bet" marked and is paid and the rest are cleared, completing the "full-game". Once the entire field is cleared, a new "full-game" can begin again. In a second preferred exemplary embodiment, the players make a one-time wager, either inside the field 16, the outside the field 16, or in the poker wager area 80 or any combination of these bets. Once these one-time wagers have all been placed, the dealer takes the top card off the deck and places it face down as a "Burn Card." Then the next card is flipped face up and this is the "Outcome Card". The outcome card is placed in the outcome card place 102 on the table 12. The dealer then marks on the field 16 the position that matches the outcome card. The dealer then repeats the burn card, outcome card and marking steps (after the final time, dealer also marks any winning poker hand positions) until all outcome cards are showing. Only at this point, the dealer clears all the bets that have not won, and then pays the wins. This then completes a game. In a third preferred exemplary embodiment, at the first opening of betting, players may place bets in any wagering area of the table.

Anywhere in the field 16 of one card bets, (e.g. a single card bet, a two card bet, a four card or corner bet, a number or street bet, a split street bet, an any suit bet, a split suit bet, a color bet, an any number bet, an any face or ace bet, or a 3 way bet such as "One Eyed Jack or Suicide king", or a joker with 2 aces split). Players can also place a onetime bet towards a progressive jackpot, by placing a dollar into the "Progressive Jackpot" slot (in this example in a slot 110 in front of each player at the table 12), to which collectively pays those players (who placed the progressive wager) in that particular series of rounds.

If a Poker Hand is made, the payout from the progressive jackpot is as follows: "Five of a Kind" pays from about 50% to 100% of Jackpot, "Royal Flush" pays from about 30% to 60%, "Straight Flush" pays from about 10% to 30%, and "Four of a Kind" pays from about 5% to 10%. Those skilled in the art will appreciate that other combination of percentages may be used and those listed above are presented for exemplary purposed without limiting the scope of the present invention of the game 10.

It is also contemplated that these payout percentages can vary and may be increased or decreased at the discretion of the house. It is also contemplated that one may choose other criteria for determining payouts from the progressive jackpot. For the player to win the Poker Hand the "Progressive Jackpot" bet, the players must wait through all single card betting rounds which results in all the cards coming out (for that game) and making the Poker Hand. Note that a Joker shown as part of the shown outcome cards, counts as a wild card, or has multiple values, and only the best possible poker hand wins. After a short time, the dealer will close or stop allowing players to make bets, by stating "no more bets" or an equivalent phrase, at which time no further "poker hand bets" or "Progressive Jackpot bets" will be allowed until the next game begins.

The dealer removes the first card from the card shoe or holder 14, keeping it face down, and places it in the box marked "card 1" of the section 102, this is a burn card. Next, the dealer removes another card from the shoe and flips it up on top of the burn card in the box marked "card 1". The value of this card is to be marked in the field 16 with the marking means, and all bets in the field that do not correlate to the card marked are cleared by removing them from the playing surface, preferably into a bin in the dealer area that will sort them by color, count them, making them ready to be placed in the dealer area again for purchase.

With all losing bets cleared, the dealer goes through, and pays all winning field bets. Following the completion of payouts, the dealer removes the marking means from the field and winning players are to clear their winnings Once again betting for the field, except for the poker hand bets and the progressive jackpot bets, is open and betting on the outcome of card two can take place. The steps of dealing, placing, marking and paying again take place.

The procedure repeats, until all outcome cards have been shown, after the final outcome card has been dealt and marked, the dealer will announce the best "Poker Hand" made, (if any) from the cards that have come out. "Poker Hands" may use either joker (or both) as wild cards, if shown, to make the best five card hand. Note that a Joker shown as part of the shown cards, it counts as a wild card and only the best possible poker hand wins. From there the dealer clears the losing poker hand bets and pays the winning bets of the correlating poker hand.

Finally, if the "Poker Hand" made correlates to a win for the "progressive jackpot", the players around the table who played the progressive for that round are paid by divided up the winning percent of the jackpot equally, if no jackpot hand is made, the players have lost, and their losing progressive bets may be added to the jackpot value for future games. The progressive jackpot can continue to accumulate value, game after game, until a player wins the pot or a portion of the pot. It is also contemplated that this progressive jackpot could be an amalgamated jackpot from any number of individual gaming tables. The value of this pot may be displayed at the table 12, for example, via the display tree 104 as shown in FIG. 2. It is contemplated that this display tree 104 can display other information, such as but not limited to, pot values, last card or cards shown, last poker hands made and when, advertisements and promotional materials.

Figure 3:
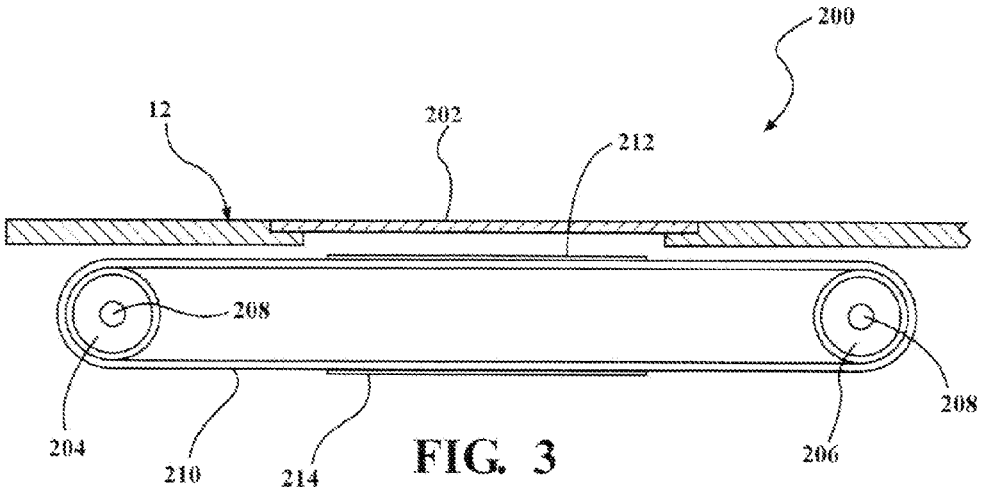
FIG. 3 illustrates a mechanical device adaptable to change the surface of the table wherein the user may choose between a game of the present invention wherein segments such as "Flush", "Royal Flush", "Straight Flush", "Straight", "5 of A Kind", " 4 of A Kind", "3 of A Kind", "Full House", " Two Pairs", and "One Pair" will appear on the surface of the table as illustrated in FIG. 1 and a conventional poker game when the mechanical device will allow the user to eliminate the segments such as "Flush", "Royal Flush", "Straight Flush", "Straight", "5 of A Kind", " 4 of A Kind", "3 of A Kind", "Full House", " Two Pairs", and "One Pair" as shown in FIG. 2.
Figure 4:
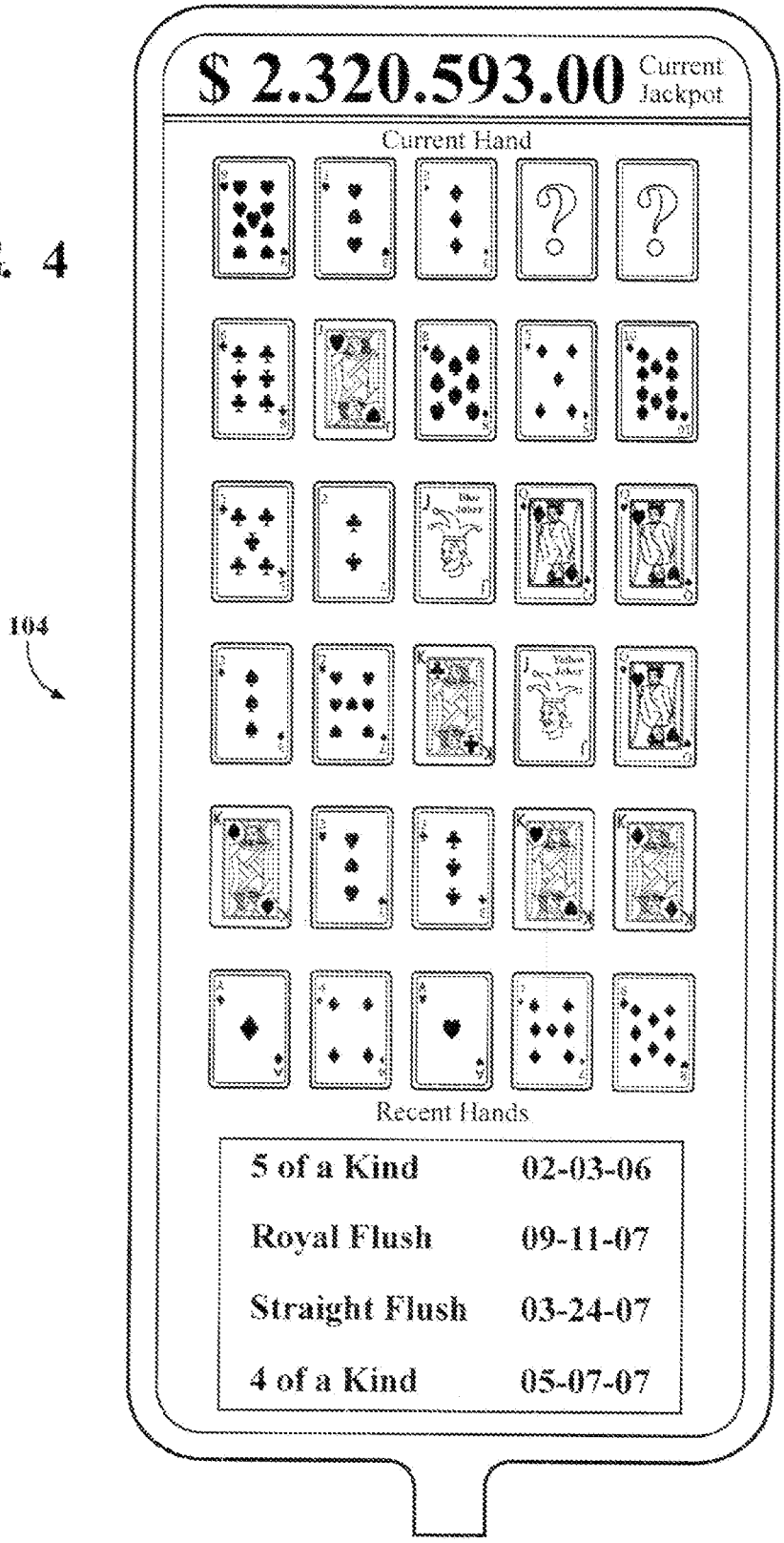
FIG. 4 illustrates an example of a display tree adjacent the table of FIG. 1.

Referring to FIG. 3, a mechanical device of the present invention is generally shown at 200. A plurality of sections 202 are defined in the surface and may be defined by any material that is clear, such as glass, plastic file, or simply be open windows. Each section 202 is located above wagering subsections such as the "Flush" subsection 82', the "Royal Flush" subsection 84', the "Straight Flush" subsection 86', the "Straight" subsection 88', the "5 of A Kind" subsection 90', the "4 of A Kind" subsection 92', the "3 of A Kind" subsection 94', the "Full House" subsection 96', the " Two Pairs" subsection 98', and the "One Pair" subsection 100', shown at FIG. 3 at the surface of the table 12 . The mechanical device may be positioned as a separate device below each section 202 or can be positioned as a single mechanical device to cooperate with each section 202. Each device 200 a pair of rollers 204 and 206, rotatable about respective axis 208. A strip 210 is entrained about the rollers 204 and 206 to define two faces 212 and 214 with one face 212 presenting a surface 216 having the first color to match with the first color of the table 12 surface and another of the faces 214 presenting a layer 218 with graphical representation of sections defined by "Flush", "Royal Flush", "Straight Flush", "Straight", "5 of A Kind", " 4 of A Kind", "3 of A Kind", "Full House", " Two Pairs", and "One Pair", wherein the rollers 204 and 206 are rotated about the axis 208 to move the strip 210 between the first gaming mode, to play the game of the present invention, and a second gaming mode, to play a conventional game of a poker, wherein the subsections such as the "Flush" subsection 82', the "Royal Flush" subsection 84', the "Straight Flush" subsection 86', the "Straight" subsection 88', the "5 of A Kind" subsection 90', the "4 of A Kind" subsection 92', the "3 of A Kind" subsection 94', the "Full House" subsection 96', the " Two Pairs" subsection 98', and the "One Pair" subsection 100', will disappear from the surface of the table 12.

After the bets are paid on the entire table, the dealer clears the marker, and removes the deck from the shoe 14, gathers up all the cards and shuffles the entire card deck over again, and the process starts over with a new game. In a fourth preferred exemplary embodiment, the game can consist of a total of up to seven rounds or more. In this case, the outcome of the poker hand would be determined on the best combination of five of the outcome cards, with any extra outcome cards being not used to determine the poker hand outcome.

Additionally, it is contemplated that these unused outcome cards could be the basis for some other kind of wager. In a fifth preferred exemplary embodiment, the game can consist of only three rounds. In this case, the outcome of the poker hand would be based only upon these three cards and poker wagers such as 4-of-a-kind and the like would obviously not be available.

In one preferred aspect of the invention, the Jokers used are not black or red, but are some other colors (e.g. a BLUE Joker and a YELLOW Joker).

In another preferred aspect of the invention, the game 10 can be played with more than one deck of cards. The deck or decks of cards may be shuffled before the start of each game. The more decks of cards used, generally, the less often the cards must be shuffled. It is also contemplated that the deck of cards can be shuffled or randomized by a manual or automated process or a combination of both. The wagering has preferred payout odds to keep the dealer or house profitable as well as keep the players excited and coming back for more. The payouts are as follows:

Inner and Outer Field Bets Any Single Card (including a joker) range from about 10/to/1 to 100/to/1, preferably from less than about 60/to/1, and more preferably from less than about 47/to/1. Any Split (2 cards) range from about 10/to/1 to 50/to/1, preferably from less than about 40/to/1, and more preferably from less than about 23/to/1. Any Corner (4 cards) range from about 3/to/1 to 30/to/1, preferably from less than about 20/to/1, and more preferably from less than about 11/to/1. Any Street (any single card in any suit) range from about 2/to/1 to 30/to/1, preferably from less than about 20/to/1, and more preferably from less than about 10/to/1. Any Suit range from about 1/to/1 to 10/to/1, preferably from less than about 5/to/1, and more preferably from less than about 2/to/1. Color bet range from about 0.5/to/1 to 10/to/1, preferably from less than about 6/to/1, and more preferably from less than about 1/to/1.

Alluding to the above, any Face or Ace range from about 1/to/1 to 10/to/1, preferably from less than about 6/to/1, and more preferably from less than about 2/to/1. Any Number range from about 1/to/1 to 10/to/1, preferably from less than about 6/to/1, and more preferably from less than about 2/to/1. Suicide king/one eye jack 16 to 1 range from about 5/to/1 to 30/to/1, preferably from less than about 20/to/1, and more preferably from less than about 16/to/1.

"Poker Hand" bets pair range from about 1/to/1 to 10/to/1, preferably from less than about 6/to/1, and more preferably from less than about 3/to/1. 3/kind range from about 2/to/1 to 10/to/1, preferably from less than about 6/to/1, and more preferably from less than about 5/to/1. Straight range from about 2/to/1 to 40/to/1, preferably from less than about 20/to/1, and more preferably from less than about 10/to/1. Flush range from about 3/to/1 to 80/to/1, preferably from less than about 40/to/1, and more preferably from less than about 20/to/1. 4/kind range from about 10/to/1 to 200/to/1, preferably from less than about 60/to/1, and more preferably from less than about 50/to/1.

Alluding to the above, straight Flush range from about 10/to/1 to 1000/to/1, preferably from less than about 250/to/1, and more preferably from less than about 100/to/1. Royal Flush range from about 100/to/1 to 10000/to/1, preferably from less than about 1500/to/1, and more preferably from less than about 1000/to/1. 5/Kind range from about 1000/to/1 to 25000/to/1, preferably from less than about 6000/to/1, and more preferably from less than about 5000/to/1. All of the aforementioned ranges are illustrated for exemplary purposes are are not intended to limit the scope of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for playing a wagering game of cards allowing players to place bets, said apparatus comprising:

a table surface of a first color presenting a dealer section and players section;

a playfield including a plurality of sections with a first of said sections presenting several rows with each of said rows divided by cells wherein each cell present different kind of cards ranging from the card having the highest kind to the card having a lowest kind with all of said card being of a single suit allowing the players to place the bets anywhere in said sections;

a second of said sections extending from said first section presenting color identifiers allowing the players to place the bets on any of said color identifiers;

a third of said sections extending from said first section presenting kind identifiers of various colors allowing the players to place the bets on any of said kind identifiers;

a fourth of said sections extending from said first section presenting a row extending in parallel relationship with said several rows of said first sections and divided into cells of said fourth section and aligned with said cells of said rows of said first sections allowing the players to place the bets on any of said cells of said fourth section;

a card section having a plurality of segment wherein the number of said segment equals to the number of gaming rounds played by the players to allow a dealer to place the cards on each of said segments; and a mechanical device adjacent said surface presenting two sides with one side presenting a wagering section including a plurality of winning options with each of said winning options presenting different winning combination values with said wagering section allowing the dealer to determine the winning outcome of each round as the dealer opens a card placed in order to each of said segments of said card section and determining a winner of a jackpot after all cards placed on each of said segments define one of said winning options presenting different of winning combination values and the other of said side presenting said first color to match with said surface wherein said mechanical device is movable between a first game mode to add said wagering section including a plurality of winning options with each of said winning options presenting different winning combination values and a second game mode wherein said wagering sections are remove from said surface;

wherein said mechanical device is further defined by a pair of rollers and a strip entrained about said rollers to define two faces with one presenting a surface having said first color to match with said first color of said table surface and another of said faces presenting graphical representation of sections defined by "Flush", "Royal Flush", "Straight Flush", "Straight", "5 of A Kind", " 4 of A Kind", "3 of A Kind", "Full House", " Two Pairs", and "One Pair", wherein said rollers are rotated to move said strip between said first gaming mode and said second gaming mode; and said table defining a step having an L-shape to receive each section with said section being coplanar with said table whereby a length of said section is longer than a length of said faces.

2. An apparatus as set forth in claim 1 wherein said winning options presenting different winning combination values are further defined by "Flush", "Royal Flush", "Straight Flush", "Straight", "5 of A Kind", " 4 of A Kind", "3 of A Kind", "Full House", " Two Pairs", and "One Pair".

3. An apparatus as set forth in claim 2 wherein the number of said segments equals to five of said segments.

4. An apparatus as set forth in claim 1 wherein said plurality of said sections is further defined by four rows with each of said rows presenting separate suits such as "Spade", "Clubs", "Diamonds", and "Hearts" with each of said rows presenting said cells ranging from "Ace" to "2".

* * * * *